US006010547A

United States Patent [19]

Jeong et al.

[11] Patent Number: 6,010,547

[45] Date of Patent: Jan. 4, 2000

[54] COUNTERFLOW TYPE PARTICULATE MATTER FILTER TRAP SYSTEM HAVING METAL FIBER FILTER

[75] Inventors: Young-Il Jeong; Jin-Wook Lee, both of Taejon, Rep. of Korea

[73] Assignee: Korea Institute of Machinery and Materials, Taejon, Rep. of Korea

[21] Appl. No.: 09/006,116

[22] Filed: Jan. 13, 1998

[51] Int. Cl.[7] ..... B01D 46/10; B01D 41/04

[52] U.S. Cl. ..... 55/282.3; 055/283; 055/287; 055/302; 055/314; 055/521; 055/525; 055/DIG. 10; 055/DIG. 30

[58] Field of Search ..... 55/283, 286, 287, 55/302, 312, 314, DIG. 10, DIG. 30, 521, 525, 527, 282.3

[56] References Cited

U.S. PATENT DOCUMENTS

| | | | |
|---|---|---|---|
| 4,512,147 | 4/1985 | Wong | 55/DIG. 30 |
| 4,522,027 | 6/1985 | Hasegawa et al. | 55/DIG. 10 |
| 4,833,883 | 5/1989 | Oda et al. | 55/DIG. 30 |
| 4,945,722 | 8/1990 | Goerlich | 55/314 X |
| 5,123,243 | 6/1992 | Baddour | 55/DIG. 30 |
| 5,253,476 | 10/1993 | Levendis et al. | 60/279 |
| 5,390,492 | 2/1995 | Levendis | 55/302 X |
| 5,426,936 | 6/1995 | Levendis et al. | 55/DIG. 30 |
| 5,489,319 | 2/1996 | Tokuda et al. | 55/DIG. 30 |
| 5,595,581 | 1/1997 | Ichikawa et al. | 55/DIG. 30 |
| 5,634,952 | 6/1997 | Kasai et al. | 55/DIG. 30 |
| 5,725,618 | 3/1998 | Shimoda et al. | 55/DIG. 30 |
| 5,820,833 | 10/1998 | Kawamura | 55/DIG. 30 |

FOREIGN PATENT DOCUMENTS

| | | | |
|---|---|---|---|
| 0115722 | 8/1984 | European Pat. Off. . | |
| 0 674 098 | 9/1995 | European Pat. Off. . | |
| 0 764 455 | 3/1997 | European Pat. Off. . | |
| 31 48 721 | 7/1983 | Germany . | |
| 41 34 949 | 4/1993 | Germany . | |
| 2-075711 | 3/1990 | Japan | 55/DIG. 30 |
| 4-267913 | 9/1992 | Japan | 55/DIG. 10 |
| 7-119441 | 5/1995 | Japan . | |
| 2239615 | 7/1991 | United Kingdom | 55/DIG. 10 |

*Primary Examiner*—Robert H. Spitzer
*Attorney, Agent, or Firm*—Fish & Richardson P.C.

[57] ABSTRACT

Disclosed is a counterflow type filter trap system for filtering particulate matters from engine exhaust gases. A controller for receiving and sending information signals, is included. A metal fiber filter for capturing particulate matters included in the engine exhaust gases is provided. A back pressure sensor for sensing pressure difference between the inlet and the outlet of the metal fiber filter, is formed. A compressed air supplying portion is formed for injecting a compressed air in the opposite direction to the flow of the exhaust gases to separate the captured particulate matters from the metal fiber filter. A particulate matters collecting box for collecting the separated particulate matters and a guiding valve for guiding the separated particulate matters are provided. The life of the filter is lengthened and the apparatus has a simple structure. The filtering efficiency of the exhausted fumes is very high.

8 Claims, 3 Drawing Sheets

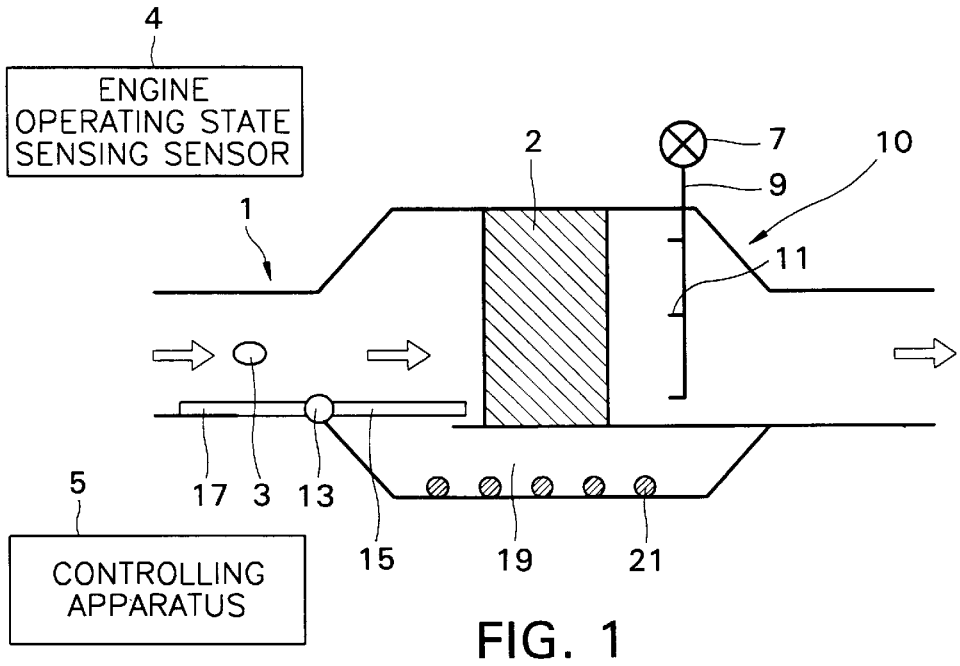
FIG. 1
FIG. 2
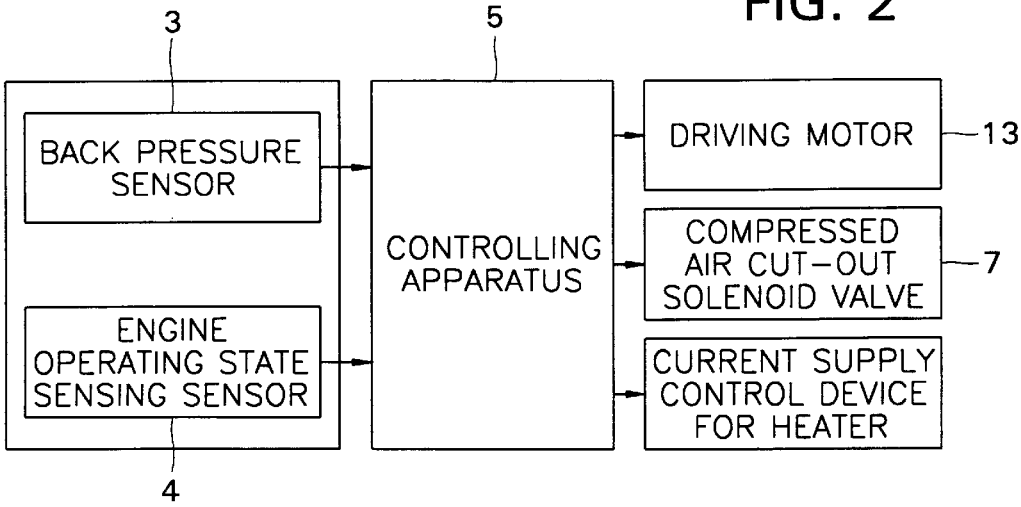

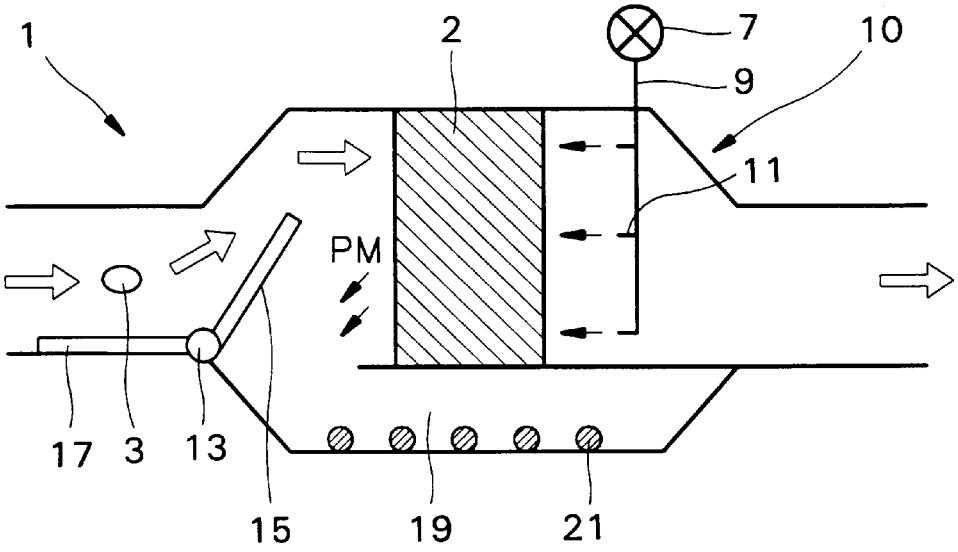
FIG. 3
FIG. 4
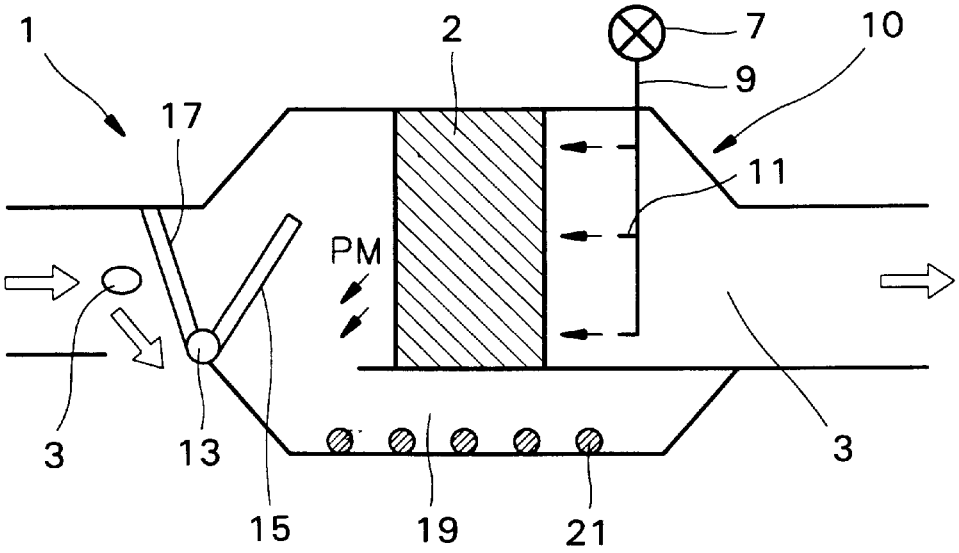

COUNTERFLOW TYPE PARTICULATE MATTER FILTER TRAP SYSTEM HAVING METAL FIBER FILTER

BACKGROUND OF THE INVENTION

1. Field of the Invention

The present invention relates to a filtering apparatus for filtering particulate matters (PM) which are exhausted from engine exhaust fumes from automobiles utilizing gasoline, and more particularly, to a counterflow type particulate matter trap system which has a metal fiber filter, collects the particulate matters by means of the fiber filter and removes the captured particulate matters by a counterflow air.

2. Description of the Prior Art

Generally, by particulate matters it is meant by incomplete combustion matters such as dust generated from an internal combustion engine. Particularly, a large amount of particulate matters are generated from an engine using gasoline. Accordingly, at the exhaust line of the diesel engine, a filtering apparatus is installed for removing the particulate matters. However, the filtering apparatus is very expensive and improving its durability and efficiency is needed. Moreover, the regenerating method which is the core technology of the filtering apparatus is complicated and the control thereof is difficult.

SUMMARY OF THE INVENTION

Accordingly, it is an object of the present invention to provide a counterflow type particulate matter filter trap system having a metal fiber filter, which has a particulate matters collecting box for collecting the particulate matters, has an electric heater in the collecting box for burning and removing the particulate matters, and has a relatively simple controller.

To accomplish the object, there is provided in the present invention a counterflow type particulate matter filter trap system having a metal fiber filter comprising a controller for receiving and sending information signals, a metal fiber filter for capturing particulate matters from engine exhaust gases, a back pressure sensor for sensing a pressure difference between an inlet and an outlet of the metal fiber filter and for transmitting a signal on the pressure difference to the controller, a compressed air supplying portion which operates by a signal from the controller which outputs an information signal according to the signal received from the back pressure sensor, for injecting a compressed air in an opposite direction to a flow of the exhaust gases in order to separate the captured particulate matters from the metal fiber filter, a particulate matters collecting box for collecting the particulate matters separated from the metal fiber filter, and a guiding valve for guiding the particulate matters separated from the metal fiber filter into the particulate matters collecting box.

Preferably, the compressed air supplying portion comprises a compressed air on-off solenoid valve which is opened and closed by the controller installed at an outer portion of the filter trap system, a compressed air supplying line which passes through the filter trap system from an outer portion to an inner portion of the filter trap system and is connected to the compressed air on-off solenoid valve to introducing the compressed air from the compressed air on-off solenoid valve into the inner portion of the filter trap system, and a compressed air supplying nozzle for injecting the compressed air introduced from the compressed air supplying line to the metal fiber filter.

Further, at least one electric heater is provided in the particulate matters collecting box for burning the collected particulate matters from the metal fiber filter. When electric power is supplied to the electric heater, an appropriate amount of the electric power should be supplied according to the engine operating condition so that the engine is not excessively over loaded.

The metal fiber filter is preferably a corrugated metal fiber filter. The guiding valve rotates and rises to a predetermined degree for opening an inlet of the particulate matters collecting box and guiding the particulate matters into the collecting box.

More preferably, the filter trap system further comprises a sensor for sensing an engine operating condition for providing information to the controller and a by-pass valve for controlling a passageway of the exhaust gases according to a signal from the controller.

Accordingly, during the regeneration of collected particulate matters, the by-pass valve is operated to cut-off a flow of the exhaust gases to the metal fiber filter while forming a separate exhausting passageway to an outer portion of the filter trap system by the controller which receives information from the sensor for sensing engine operating condition when an engine velocity is higher than a predetermined velocity and when an engine load is higher than a predetermined load.

According to another embodiment of the present invention, there is provided a counterflow type particulate matter filter trap system having a metal fiber filter comprising:

1) a controller for receiving and sending information signals; and
2) a first and a second filter trap systems comprising:
   a first and a second metal fiber filters for capturing particulate matters in engine exhaust gases, a first and a second back pressure sensors for respectively sensing pressure differences between inlets and outlets of the first and the second metal fiber filters and for transmitting signals on the pressure differences to the controller, a first and a second compressed air supplying portions which operate by signals from the controller which outputs information signals according to the signals received from the first and the second back pressure sensors, for respectively injecting compressed airs to opposite directions to flows of the exhaust gases in order to separate the captured particulate matters at the first and the second metal fiber filters, a first and a second particulate matters collecting boxes for respectively collecting the particulate matters separated from the first and the second metal fiber filters, and a first and a second guiding valves for respectively guiding the particulate matters separated from the first and the second metal fiber filters according to information signals sent from the controller.

Preferably, one inlet of the first and the second particulate matter filter trap system are opened by one of the first and the second guiding valve, and the remaining guiding valve does not operate so as to not open an inlet of a corresponding particulate filter trap system.

BRIEF DESCRIPTION OF THE DRAWINGS

The above object and advantages of the present invention will become more apparent by describing in detail preferred embodiments thereof with reference to the attached drawings in which:

FIG. 1 is a cross-sectional view of a counterflow type particulate matter filter trap system according to an embodiment of the present invention;

FIG. 2 is a block diagram for showing the flow of the electric signals of the filter trap system illustrated in FIG. 1;

FIG. 3 is a cross-sectional view for showing the operating state of the filter trap system illustrated in FIG. 1 when an engine is in a state of low velocity and low load;

FIG. 4 is a cross-sectional view for showing the operating state of the filter trap system illustrated in FIG. 1 when an engine is in a state of high velocity and high load.

DETAILED DESCRIPTION OF THE INVENTION

Figure 5:
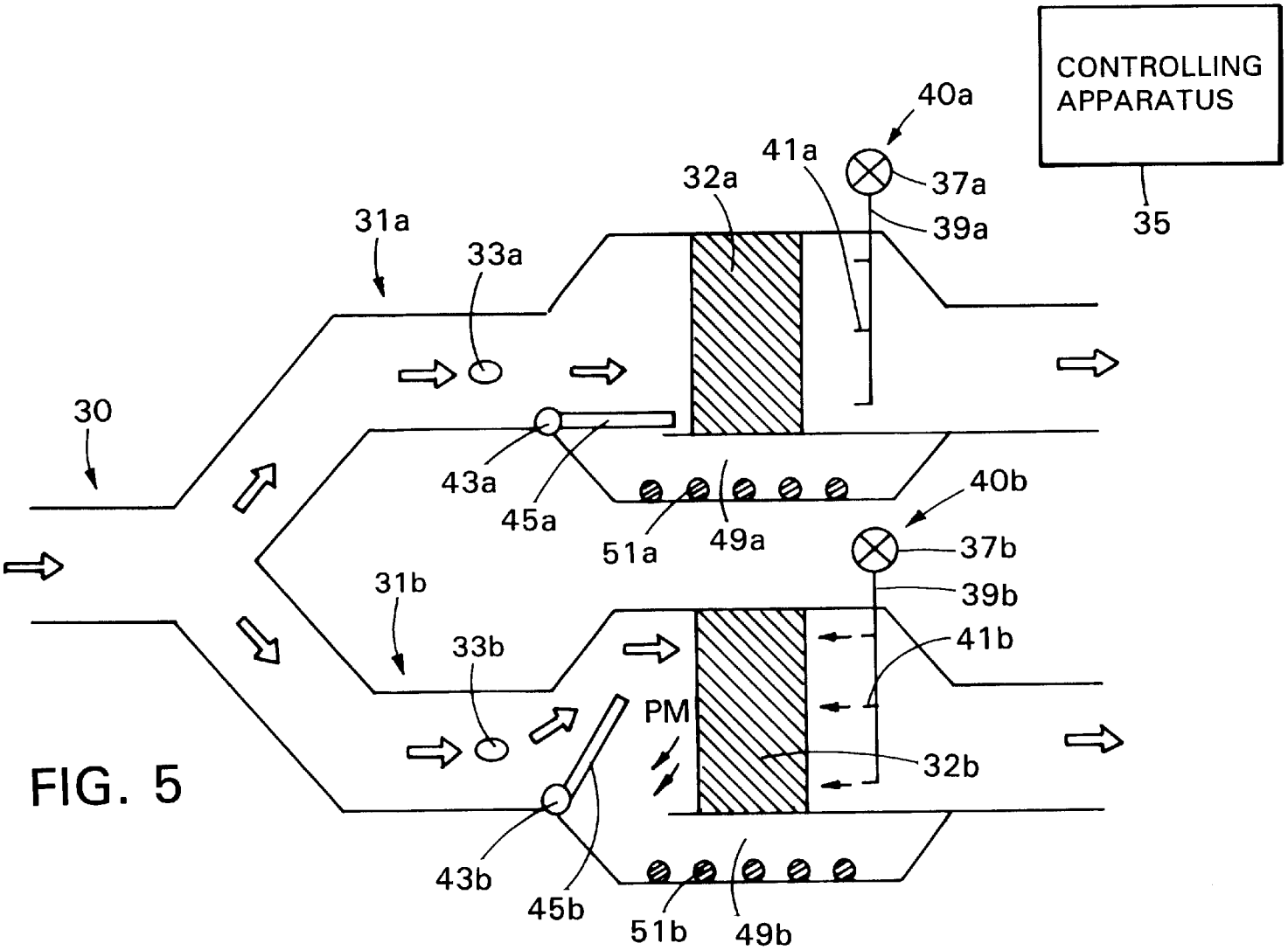
FIG. 5 is a cross-sectional view of a counterflow type particulate matter filter trap system according to another embodiment of the present invention.

Hereinafter, the filter trap system according to an embodiment of the present invention will be explained in more detail with reference to the accompanying drawings.

FIG. 1 is a cross-sectional view of a counterflow type particulate matter filter trap system according to an embodiment of the present invention, and FIG. 2 is a block diagram for showing the flow of the electric signals of the filter trap system.

Referring to FIG. 1, a particulate matter filter trap system 1 according to this embodiment of the present invention includes a metal fiber filter, preferably a corrugated metal fiber filter 2 for capturing the particulate matters, a back pressure sensor 3 for sensing a gas pressure difference in filter trap system 1, a controller 5 for receiving information from back pressure sensor 3 and an engine operating condition sensing sensor 4, and for controlling various operations, a compressed air supplying portion 10 which includes a compressed air on-off solenoid valve 7, for supplying a compressed air to corrugated metal fiber filter 2, a compressed air supplying line 9 and a compressed air supplying nozzle 11, a particulate matters collecting box 19 for collecting the accumulated particulate matters, a guiding valve 15 for opening and closing the upper portion of particulate matters collecting box 19, a by-pass valve 17 for opening and closing the inlet of filter trap system 1, a driving motor 13 for driving by-pass valve 17, and an electric heater 21 for burning the collected particulate matters in collecting box 19.

At one portion of filter trap system 1, an inlet for sucking exhaust gases from an engine (not shown) is provided, and an outlet for exhausting the sucked gas is provided at the other portion thereof. At the center portion of the body of filter trap system 1, corrugated metal fiber filter 2 is installed, and particulate matters collecting box 19 is formed at the lower portion of the body of filter trap system 1. Electric heater 21 is disposed at the inner and lower surface portion of particulate matters collecting box 19. Valve driving motor 13 is installed at the contacting portion of particulate matters collecting box 19 with the inlet.

At one portion of valve driving motor 13 and above particulate matters collecting box 19, guiding valve 15 is formed for opening and closing one upper portion of particulate matters collecting box 19. At the other portion of valve driving motor 13, by-pass valve 17 is installed for opening and closing the inlet of filter trap system 1. And between corrugated metal fiber filter 2 and the outlet of the filter trap system, compressed air supplying line 9 is vertically extended from the outer portion of the body to the lower portion of corrugated metal fiber filter 2. At one end of compressed air supplying line 9, a plurality of compressed air supplying nozzles 11 are protrusively formed to a fixed distance toward corrugated metal fiber filter 2. At the upper end portion of compressed air supplying line 9, compressed air on-off solenoid valve 7 is installed.

Back pressure sensor 3 is installed at the center portion where the inlet and the body are connected. Controller 5 is separately formed from filter trap system 1.

The operation of controller 5 will be explained with reference to the block diagram in FIG. 2 and FIG. 1. First, back pressure sensor 3 senses the gas pressure at the inlet before the gas passes metal fiber filter 2, and transmits this information to controller 5. In addition, engine operating condition sensing sensor 4 senses the rotating velocity and the load of the engine and transmits this information to controller 5. Controller 5 receives the two kinds of information, judges the accumulated degree of the particulate matters from the information from back pressure sensor 3 and determines the engine operating condition from the information from engine state sensing sensor 4. When controller 5 judges that an appropriate amount of particulate matters is accumulated through the information from back pressure sensor 3, the controller opens compressed air on-off solenoid valve 7 to inject the compressed air through compressed air supplying line 9 and compressed air supplying nozzle 11 in the opposite direction to the exhaust gases. In addition, controller 5 judges the flowing velocity of the exhaust gases according to the engine operating condition to determine if it opens by-pass valve 17 or not and transmits the judgement to driving motor 13.

The operating principle of the filter trap system and the method for filtering the exhaust gases according to this embodiment will be described in detail below.

When the engine (not shown) starts to operate, the engine exhaust gases flow from the engine into filter trap system 1. The arrows illustrated in FIG. 1 represent the flowing direction of the engine exhaust gases from the engine.

When the exhaust gases move along the direction indicated by the arrows from the inlet and pass through corrugated metal fiber filter 2 which is disposed at the center portion, the particulate matters included in the exhaust gases is captured by filter 2. As the particulate matters are accumulated, a difference between the pressure at the inlet portion of filter trap system 1 and the pressure at the outlet portion after filter 2, is generated. As time goes by, the amount of the particulate matters increases and the pressure difference becomes larger. Back pressure sensor 3 installed at the inlet portion of filter trap system 1 senses the two pressure difference and transmits the pressure difference to controller 5. Meanwhile, engine operating condition sensing sensor 4 installed at a predetermined position, senses the rotating speed and the load of the engine to transmit this information to controller 5.

Controller 5 receives signals from back pressure sensor 3 which transmits the pressure difference between the inlet and the outlet of the filter trap system and from engine state sensing sensor 4 which senses the rotating velocity and the load of the engine, and determines the separating time of the particulate matters. When the separating time of the particulate matters is determined, controller 5 supplies electric power to valve driving motor 13 which is installed at the inlet portion of filter trap system 1 to drive valve driving motor 13. Valve driving motor 13 lets guiding valve 15 which is horizontally provided at one side of driving motor 13, rotate upward with driving motor 13 as the axis, to open particulate matters collecting box 19 which is provided at the lower portion of filter trap system 1.

At the same time, compressed air on-off solenoid valve 7 installed above the outlet of filter trap system 1, is opened to supply the compressed air through compressed air supplying line 9 which is vertically extended from compressed air on-off solenoid valve 7 to the inner portion of filter trap system 1. Compressed air supplying line 9 includes at least one compressed air supplying nozzle 11 which is protruded toward metal fiber filter 2 of filter trap system 1. Accordingly, the supplied compressed air is transmitted to compressed air supplying nozzle 11 from compressed air supplying line 9. The compressed air is injected from compressed air supplying nozzle 11 into metal fiber filter 2 in the opposite direction to the engine exhaust gases, to separate the particulate matters from corrugated metal fiber filter 2. At this time, since compressed air supplying nozzle 11 supplies the compressed air in the opposite direction to the engine exhaust gases to corrugated metal fiber filter 2, the particulate matters overcome the pressure of the exhaust gases and fall toward the inlet portion of filter trap system 1.

The separated particulate matters from metal fiber filter 2 are guided by rotated guiding valve 15 and are collected at the opened collecting box 19. After completing the collection of the particulate matters, driving motor 13 operates guiding valve 15 to shut collecting box 19, and the exhaust gases continuously pass through metal fiber filter 2. Electric heater 21 is provided in particulate matters collecting box 19. The electric power is supplied to electric heater 21 by a signal from controller 5 and the collected particulate matters are fired by heater 21. At this time, the amount of the supplied electric power to electric heater 21 should be controlled so as not to excessively affect engine operation.

The filter trap system according to this embodiment controls the by-pass valve to minimize the by-pass ratio of the exhaust gases according to the engine state. The engine state can be classified into a low velocity and low load state and a high velocity and high load state. FIG. 3 illustrates the operating state of the filter trap system when the engine is in the state of low velocity and low load and FIG. 4 illustrates the operating state of the filter trap system when the engine is in the state of high velocity and high load. These will be compared, hereinafter. In FIGS. 3 & 4, the same reference numerals are given to the same parts.

First, the operation of the filter trap system when the engine is in the state of low velocity and the low load, will be explained with reference to FIG. 3. Controller 5 determines the separating time of the particulate matters by the received signals from back pressure sensor 3 which transmits the pressure difference between the inlet and the outlet, and from engine state sensor 4 which senses the rotating velocity and the load of the engine. At the separating time, controller 5 operates valve driving motor 13 to rotate guiding valve 15 upward.

When particulate matters collecting box 19 is opened, compressed air on-off solenoid valve 7 which is installed above the outlet, is opened to supply the compressed air through compressed air supplying line 9. The compressed air is supplied through compressed air supplying nozzle 11 to metal fiber filter 2 in the opposite direction to the engine exhaust gases to separate the particulate matters from corrugated metal fiber filter 2. Since the compressed air is supplied in the opposite direction to the exhaust gases, the particulate matters fall toward the inlet of filter trap system 1, as illustrated in FIG. 3. The separated particulate matters are guided by upward opened guiding valve 15 and collected in collecting box 19.

Since the flowing velocity of the exhaust gases is weak, almost all of the particulate matters can be collected without being affected by the continuous inflow of the exhaust gases. When guiding valve 15 operates downward to close the collecting box, the particulate matters are fired by electric heater 21.

The operating state of the filter trap system when the engine is in the state of high velocity and high load, will be explained with reference to FIG. 4.

The particulate matters included in the exhaust gases are accumulated when the gas passes through corrugated metal fiber filter 2 and when the engine is in the state of high velocity and high load, as illustrated in FIG. 3. Controller 5 determines the separating time of the particulate matters from metal fiber filter 2 by the information signals from back pressure sensor 3 and engine state sensing sensor 4. Then, controller 5 also supplies the electric power to valve driving motor 13 to operate guiding valve 15 and opens compressed air on-off solenoid valve 7 to separate the particulate matters in the case when the engine is in the state of low velocity and low load.

In addition, valve driving motor 13 lets by-pass valve 17 rotate upward with valve driving motor 13 to prevent the inflow of the engine exhaust gases of high velocity into metal fiber filter 2. Accordingly, the inlet of the engine exhaust gases is cut-off and the external exhausting passageway formed at the inlet portion of filter trap system 1, is opened to exhaust out the engine exhaust gases directly to the outside without the filtering operation.

When guiding valve 15 rotates upward to open particulate matters collecting box 19, the compressed air is injected into metal fiber filter 2 through compressed air on-off solenoid valve 7, compressed air supplying line 9 and compressed air supplying nozzle 11, in the opposite direction to the engine exhaust gases. The separated particulate matters from metal fiber filter 2 are guided by guiding valve 15 and collected in opened particulate matters collecting box 19. At this time, since the inflow of the engine exhaust gases of high velocity is cut-off, the particulate matters can be safely separated and collected in the collecting box. After completing the collection, by-pass valve 17 and guiding valve 15 go back to their original positions and the engine exhaust gases pass again through metal fiber filter 2. The collected particulate matters are burned by electric heater 21 in collecting box 19.

As described above, the filter trap system according to the first embodiment can control the operations of the by-pass valve and the guiding valve according to the rotating velocity and the load of the engine. Therefore, the amount of the engine exhaust gases exhausted out to the outside without passing the metal fiber filter can be minimized.

A filter trap system according to another embodiment of the present invention will be explained in detail with reference to FIG. 5.

The filter trap system illustrated in FIG. 5 is a dual type apparatus which can be obtained by connecting two filter trap systems having almost the same constitutions with the filter trap system according to the first embodiment. The constitution of the filter trap system according to the second embodiment is as follows.

A dual filter trap system 30 according to this embodiment includes first and a second filter trap systems 31*a* and 31*b*. Dual filter trap system 30 has first and a second corrugated metal fiber filters 32*a* and 32*b* for collecting the particulate matters, first and a second back pressure sensors 33*a* and 33*b* for sensing the pressure differences between the inlets and the outlets of the exhaust gases in first and second filter trap systems 31*a* and 31*b* a controller 35 for receiving information from first and second back pressure sensors 33*a* and 33*b* and for controlling various operations, first and a second compressed air supplying portions 40*a* and 40*b*, each of which includes first and second compressed air on-off solenoid valves 37*a* and 37*b*, first and second compressed air supplying lines 39*a* and 39*b* and first and second compressed air supplying nozzles 41*a* and 41*b*, for supplying compressed air to first and second corrugated metal fiber filters 32*a* and 32*b*, respectively, first and second particulate matters collecting boxes 49*a* and 49*b* for collecting the accumulated particulate matters, first and second guiding valves 45*a* and 45*b* for opening and closing the upper portions of first and second particulate matters collecting boxes 49*a* and 49*b*, first and second driving motors 43*a* and 43*b* for driving first and second guiding valves 45*a* and 45*b*, respectively, and first and second electric heaters 51*a* and 51*b* for burning the collected particulate matters collected in first and second collecting boxes 49*a* and 49*b*, respectively.

The basic role and the basic operating principle of each part and the method for filtering the exhaust gases using the dual filter trap system are almost exactly the same as those explained in the first embodiment. Accordingly, the same content will be omitted and the different portion will be briefly explained below.

When the engine (not shown) starts to operate, the engine exhaust gases flow from the engine into dual filter trap system 30. The exhaust gases flow into the inlets of first filter trap system 31*a* and second filter trap system 31*b* in alternative manner, and the exhaust gases are filtered in each filter trap system as follows. When the exhaust gases pass through first corrugated metal fiber filters 32*a*, the particulate matters included in the exhaust gases are collected at the filters 32*a* in the same manner as that described in the first embodiment. At this time, in second filter trap system 31*b*, guiding valves 45*b* upwardly pivots so as to close the inlet thereof and to separate and remove the particulate matters collected at filter 31*b*. Meanwhile, as the amount of the accumulated particulate matters at filter 31*a* increases, the pressure difference between the pressures at the inlet portion and the pressure at the outlet portion thereof become larger. Accordingly, first back pressure sensor 33*a* senses the pressure and transmits the pressure difference to controller 35. Controller 35 determines the separating time of the particulate matters by the transmitted signal. At the separating time of the particulate matters, controller 35 supplies electric power to valve driving motor 43*a* to operate valve driving motor 43*a*. Valve driving motor 43*a* rotates guiding valve 45*a* upward to open particulate matters collecting box 49*a*. At the same time, compressed air supplying portion 40*a* injects the compressed air according to the information signal of controller 35 to separate the particulate matters.

When guiding valve 45*a* upwardly pivots so as to close the inlet portion thereof, guiding valve 45*b* of second filter trap system 31*b* downwardly pivots so as to open the inlet portion thereof and to capture the particulate matters by means of filter 32*b*. That is, guiding valves 45*a* and 45*b* are alternatively operated, thereby allowing the exhaust gases to alternatively flow therethrough.

As described above, each constituting element in each filter trap system 31*a* and 31*b* operates by the same method as that described in the first embodiment to collect, separate and remove the particulate matters from the engine exhaust gases. In the above described embodiment, since the controlling of the flowing velocity of the exhaust gases by means of the by-pass valve is not needed, the by-pass valve is not needed as in the first embodiment. In addition, the problem on the exhaustion of the exhaust gases to the outside without filtering can be solved. And therefore, the engine state sensing sensor for sensing the rotating velocity and the load of the engine and for transmitting this information to the controller, is not needed. However, it goes without saying that this sensor can be installed for sensing the engine state.

As described above, since the particulate matters are not directly treated by the filter, the life of the filter trap system can be extended. Moreover, since the supplying of electric power for burning the collected particulate matters is controlled by the controller, the supplying of the electric power can be adjusted so that no excessive stress is applied to the engine.

Further, since the structure of the filter trap system is relatively simple, the controlling of the apparatus is advantageous and the assembling productivity of the apparatus is increased.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A counterflow particulate matter filter trap system comprising:

a controller for receiving and sending information signals;

a metal fiber filter for capturing particulate matters included in engine exhaust gases, said metal fiber filter being a corrugated metal fiber filter;

a back pressure sensor for sensing a pressure difference between an inlet and an outlet of said metal fiber filter and for transmitting a signal on said pressure difference to said controller;

a compressed air supplying portion which operates by a signal from said controller which outputs an information signal according to said signal received from said back pressure sensor, for injecting a compressed air in an opposite direction to a flow of said exhaust gases to separate said captured particulate matters from said metal fiber filter, said compressed air supplying portion including a compressed air on-off solenoid valve operated by said controller, a compressed air supplying line connected to said compressed air on-off solenoid valve and extending over a full area of said metal fiber filter, and a plurality of compressed air supplying nozzles for injecting said compressed air introduced from said compressed air supplying line into the full area of said metal fiber filter;

a particulate matters collecting box for collecting said particulate matters separated from said metal fiber filter; and a guiding valve for guiding said particulate separated from said metal fiber filter into said particulate matters collecting box according to an information signal sent from said controller.

2. A counterflow particulate matter filter trap system having a metal fiber filter as claimed in claim 1, wherein at least one electric heater is provided in said particulate matters collecting box for burning said collected particulate matters by said metal fiber filter.

3. A counterflow particulate matter filter trap system having a metal fiber filter as claimed in claim 1, wherein said guiding valve rotates and rises by a predetermined degree to open an inlet of said particulate matters collecting box and guide said particulate matters into said collecting box.

4. A counterflow particulate matter filter trap system having a metal fiber filter as claimed in claim 1, further comprising a sensor for sensing engine operating condition to provide information to said controller, and a by-pass valve for controlling a passageway of said exhaust gases according to a signal from said controller.

5. A counterflow particulate matter filter trap system having a metal fiber filter as claimed in claim 4, wherein said by-pass valve is operated to cut-off a flow of said exhaust gases to said metal fiber filter and to form a separate exhausting passageway to an outer portion of said filter trap system by said controller which receives information from said sensor for sensing an engine operating condition when an engine velocity is higher than a predetermined velocity and when an engine load is larger than a predetermined load.

6. A counterflow particulate matter filter trap system comprising:

1) a controller for receiving and sending information signals; and 2) a first and second filter trap system comprising:

a first and a second metal fiber filters for capturing particulate matters in engine exhaust gases, said first and second metal fiber filters being corrugated metal fiber filters;

a first and a second back pressure sensors for respectively sensing pressure differences between inlets and outlets of said first and said second metal fiber filters and for transmitting signals on said pressure differences to said controller;

a first and a second compressed air supplying portions which operate by signals from said controller which outputs information signals according to said signals received from said first and said second back pressure sensors, for respectively injecting compressed air in opposite directions to flows of said exhaust gases to separate said captured particulate matters at said first and said second metal fiber filters, said first and said second compressed air supplying portions including first and second compressed air on-off solenoid valves operated by said controller, first and second compressed air supplying lines respectively connected to said first and said second compressed air on-off solenoid valves and extending full areas of said first and said second metal fiber filters, and a plurality of first and second compressed air supplying nozzles for respectively injecting said compressed air introduced from said first and said second compressed air supplying lines to the full areas of said first and said second metal fiber filters;

a first and a second particulate matters collecting boxes for respectively collecting said particulate matters separated from said first and said second metal fiber filters; and a first and a second guiding valves for respectively guiding said particulate matters separate from said first and said second metal fiber filters according to information signals sent from said controller.

7. A counterflow particulate matter filter trap system having a metal fiber filter as claimed in claim 6, wherein said first and said second guiding valves rotate and rise by predetermined degrees to open inlets of said first and said second particulate matters collecting boxes and guide said particulate matters into said first and said second collecting boxes.

8. A counterflow particulate matter filter trap system having a metal fiber filter as claimed in claim 7, wherein when one of inlets of said first and said second particulate martial collecting boxes is opened by one of said first and said second guiding valve, the remaining guiding valve closes an inlet of a corresponding collecting box.

* * * * *